US009648920B1

(12) United States Patent
Kuntz

(10) Patent No.: US 9,648,920 B1
(45) Date of Patent: May 16, 2017

(54) FACE MASK MOUNTING APPARATUS FOR CONTACT SPORTS HELMETS

(71) Applicant: Carl Kuntz, Waterloo (CA)

(72) Inventor: Carl Kuntz, Waterloo (CA)

( * ) Notice: Subject to any disclaimer, the term of this patent is extended or adjusted under 35 U.S.C. 154(b) by 0 days.

(21) Appl. No.: 15/261,273

(22) Filed: Sep. 9, 2016

Related U.S. Application Data

(60) Provisional application No. 62/327,777, filed on Apr. 26, 2016.

(51) Int. Cl.
*A42B 3/20* (2006.01)
*A63B 71/10* (2006.01)
*F16B 5/02* (2006.01)

(52) U.S. Cl.
CPC ..... *A42B 3/20* (2013.01); *A63B 71/10* (2013.01); *F16B 5/0241* (2013.01)

(58) Field of Classification Search
CPC .... A42B 3/00; A42B 3/04; A42B 3/08; A42B 3/18; A42B 3/185; A42B 3/20; A42B 3/22; A42B 1/08; A63B 2071/105; A63B 71/10
See application file for complete search history.

(56) References Cited

U.S. PATENT DOCUMENTS 968,036 A * 8/1910 Erickson ..... A44B 11/2523 24/607
1,203,564 A * 11/1916 April ..... A61F 9/02 2/9
3,170,164 A * 2/1965 Holder ..... A42B 3/20 2/9
5,675,875 A * 10/1997 Servatius ..... A42B 3/20 2/424
5,956,777 A * 9/1999 Popovich ..... A42B 3/065 2/412
7,607,179 B2 * 10/2009 Shih ..... A42B 3/20 2/411
9,370,216 B2 * 6/2016 Brantley ..... A42B 3/121
2008/0163410 A1 * 7/2008 Udelhofen ..... A42B 3/20 2/413
2013/0111654 A1 * 5/2013 Gorsen ..... A42B 3/205 2/421
2014/0325744 A1 * 11/2014 Klein ..... A42B 3/20 2/411

(Continued)

*Primary Examiner* — Daniel Wiley
(74) *Attorney, Agent, or Firm* — Tai W. Nahm; Miller Thomson LLP

(57) ABSTRACT

There is disclosed an improved face mask mounting apparatus for a contact sports helmet. In an embodiment, the apparatus comprises a mounting sleeve adapted to be mounted at a contact sports helmet attachment point; a mounting ring encased in the mounting sleeve and adapted to receive a mounting bolt; and a plurality of resiliently flexible impact absorption components positioned between the mounting ring and an inner wall of the mounting sleeve to generally center the mounting ring within the mounting sleeve; whereby, in use, the plurality of resiliently flexible impact absorption components are adapted to collectively absorb an impact force received on the face mask by deforming, and returning the mounting ring to its center position after the impact force has been absorbed. By way of example, the plurality of resiliently flexible impact absorption components may comprise springs or resiliently flexible and deformable rubber balls.

10 Claims, 9 Drawing Sheets

(56) References Cited

U.S. PATENT DOCUMENTS

| | | | | |
|---|---|---|---|---|
| 2015/0135413 | A1* | 5/2015 | Mayerovitch | A42B 3/064 2/414 |
| 2015/0201695 | A1* | 7/2015 | Shih | A63B 71/10 2/9 |
| 2015/0230533 | A1* | 8/2015 | Bancroft | A42B 3/20 2/424 |
| 2016/0374424 | A1* | 12/2016 | Gowen | F16B 21/09 2/421 |
| 2017/0042273 | A1* | 2/2017 | Fletcher | A42B 3/20 |
| 2017/0056752 | A1* | 3/2017 | Tubbs | A42B 3/20 |

* cited by examiner

FACE MASK MOUNTING APPARATUS FOR CONTACT SPORTS HELMETS

FIELD OF THE INVENTION

The present invention relates generally to contact sports helmets, and more particularly to improvements in face mask mounting means for contact sports helmets.

BACKGROUND

Contact sports that involve high-impact hits requires protective equipment to be worn by all players in order to minimize the risk of serious sports injuries. As the consequences of injuries to the head of contact sports players can be particularly serious, leading to concussions and possibly even chronic conditions, protecting contact sports players from repeated hard impacts to the head must be a top priority. However, many contact sports helmets have a limited ability to absorb hard impacts, particularly when the impacts are received from the front including the face mask.

What is needed is an improved face mask mounting means which addresses at least some of the limitations in the prior art.

SUMMARY

The present invention relates to an improved face mask mounting apparatus for contact sports helmets, for use in various contact sports such as football, hockey and lacrosse.

In an embodiment, the face mask mounting apparatus comprises one or more mounting sleeves for mounting on one or both sides of a contact sports helmet at a face mask attachment point. Each mounting sleeve encases a movable mounting ring which is generally centered within the mounting sleeve at rest, and also mounts a bolt passing through its center. The bolt, in turn, is mounted to or is an integral part of the face mask, and mounts the face mask to the contact sports helmet at an attachment point.

In an embodiment, the mounting ring is adapted to move in any lateral direction within a mounting sleeve upon receiving an impact force on the face mask, but the lateral movement of the mounting ring is also opposed by a plurality of resiliently flexible impact absorption components which are positioned radially around each mounting ring.

In an embodiment, the plurality of resiliently flexible impact absorption components are resiliently flexible springs which attached at a first end to a mounting ring, and attached at a second end to an inner wall of the mounting sleeves. A plurality of springs are mounted radially around the mounting ring, and generally centers the mounting ring within the mounting sleeve. In use, the plurality of springs are adapted to compress or stretch depending on the lateral direction of the mounting ring in response to an impact force on the face mask, but the springs also collectively act to return the mounting ring to its centered position within the mounting sleeve after an impact force has been absorbed.

In another embodiment, the plurality of resiliently flexible impact absorption components are resiliently flexible, deformable balls, such as soft rubber balls for example, which are radially positioned around a mounting ring and sit between the mounting ring and the inner wall of the mounting sleeve. Rather than being fastened to the mounting ring or mounting sleeve, the plurality of resiliently flexible and deformable rubber balls are free to compress when an impact force is received by the face mask, and the mounting ring moves laterally within the mounting sleeve against a number of rubber balls absorbing the impact force. After the impact force is absorbed, the plurality of rubber balls collectively return the mounting ring to its original centered position within the mounting sleeve.

In this respect, before explaining at least one embodiment of the invention in detail, it is to be understood that the invention is not limited in its applications to the details of construction and to the arrangements of the components set forth in the following description or the examples provided therein, or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

As noted above, the present invention relates to an improved face mask mounting apparatus for contact sports helmets, for use in various contact sports such as football, hockey and lacrosse.

Figure 1:
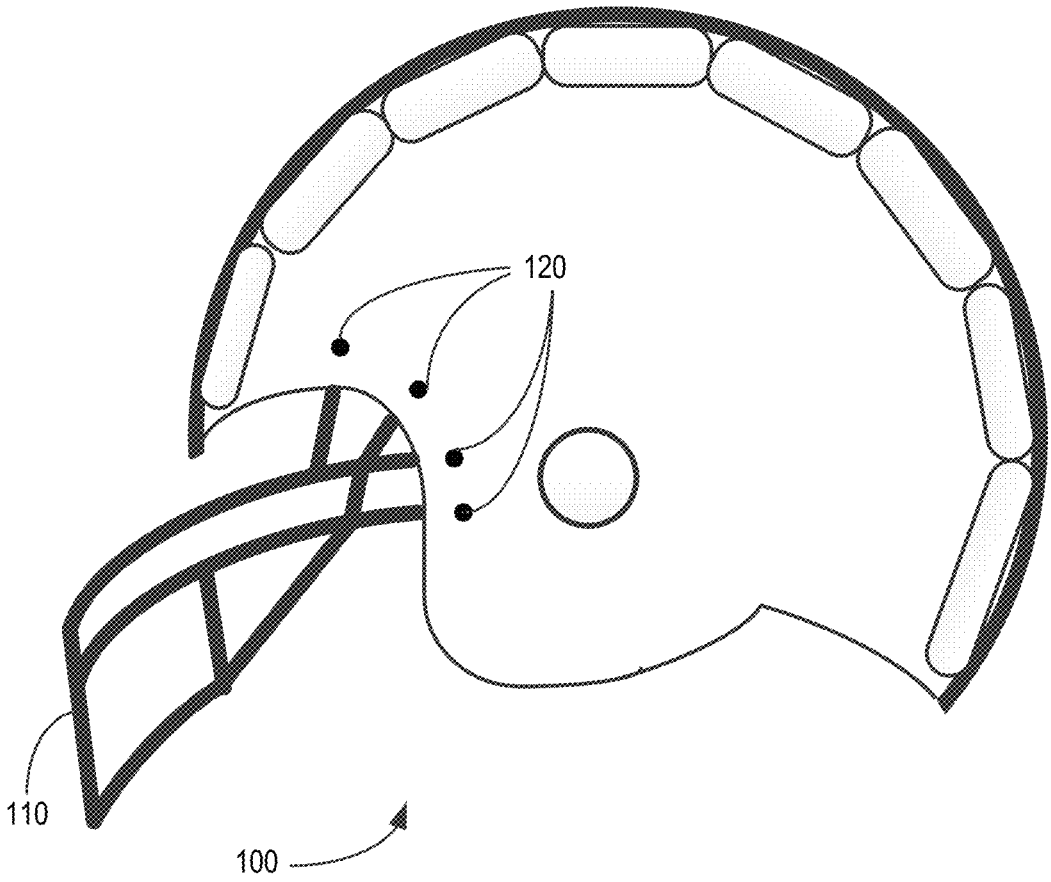
FIG. 1 (Prior Art)
FIG. 1 shows a cross-section of a contact sports helmet, in this example a football helmet, in accordance with the prior art in which a face mask is solidly mounted to the contact sports helmet at a number of attachment points.

With reference to FIG. 1, shown is a cross-section of a contact sports helmet 100, in this example a football helmet, in accordance with the prior art. In this example, the face mask is solidly mounted to the contact sports helmet at a number of attachment points. As the face mask 110 is solidly attached to the contact sports helmet 100, any impact force that is received on the face mask is largely transmitted to the contact sports helmet 100 via the solidly mounted attachment points 120. Thus, a larger impact force may be transmitted to the head of the player than is necessary, especially in comparison to the improved face mask mounting apparatus of the present disclosure. Illustrative embodiments of an improved face mask mounting apparatus which helps to absorb impact forces received on the face mask will now be described in detail with reference to the figures.

Figure 2:
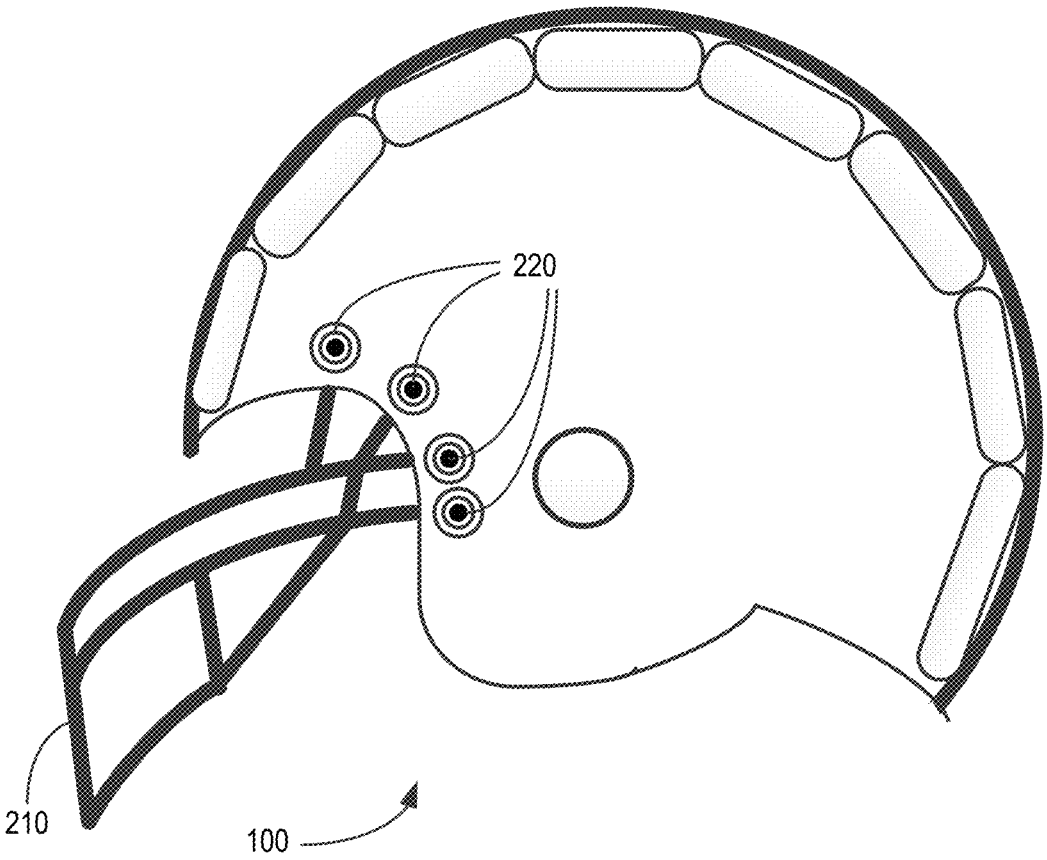
FIG. 2 shows a cross-section of a contact sports helmet, in this example a football helmet, in which the face mask is flexibly mounted to the contact sports helmet via a face mask mounting apparatus in accordance with an embodiment.

First referring to FIG. 2, shown is a cross-section of a contact sports helmet 100, in this example a football helmet. In this illustrative embodiment, the face mask 210 is flexibly mounted to the contact sports helmet via a resiliently flexible face mask mounting apparatus positioned at each of a plurality of attachment points 220. There should be at least two attachment points on each side (left side or right side) of the contact sports helmet 100, but more preferably at least three or four attachment points (as illustrated) on each side in order to distribute an impact force received on the face mask 210 more evenly over the additional attachment points 220.

Figure 3A:
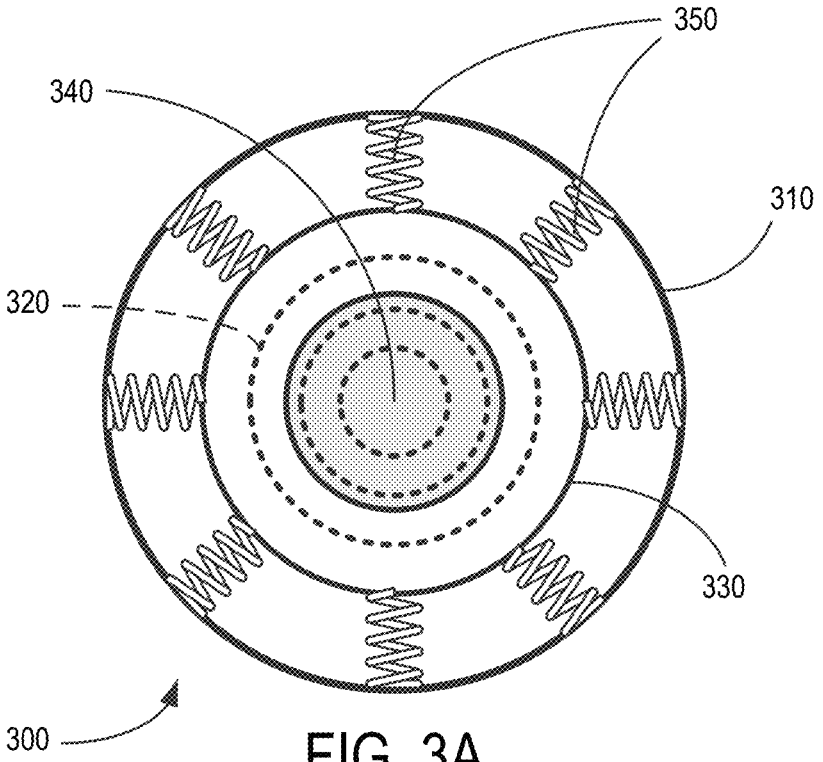
FIG. 3A shows a detailed partial cross-sectional top view of a face mask mounting apparatus in accordance with an embodiment.
Figure 3B:
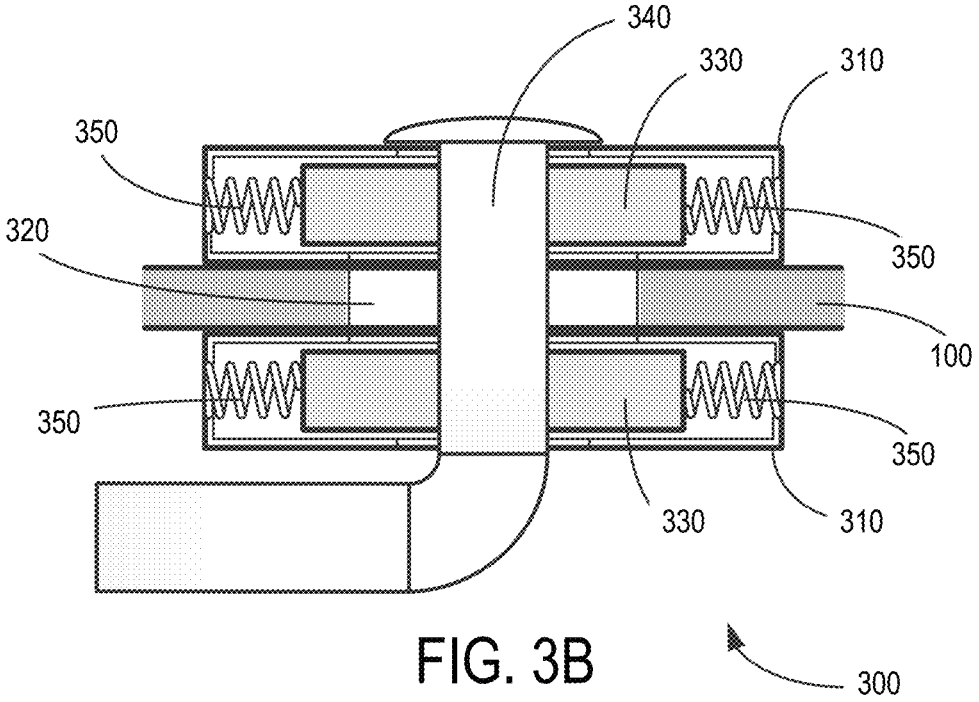
FIG. 3B shows a corresponding partial cross-sectional side view of the face mask mounting apparatus of FIG. 3A.

Now referring to FIG. 3A, shown is a detailed partial cross-sectional top view of a face mask mounting apparatus 300 in accordance with an illustrative embodiment. FIG. 3B shows a corresponding partial cross-sectional side view of the face mask mounting apparatus 300 of FIG. 3A. In this illustrative example, each face mask mounting apparatus 300 comprises first and second mounting sleeves 310 for mounting on either side of an aperture 320 formed in a contact sports helmet 100 at an attachment point 220. Each of the first and second mounting sleeves 310 includes an inner mounting ring 330 which is generally centered at rest within the mounting sleeve 310. The inner mounting ring 330 receives a mounting bolt 340 passing through its center, and is adapted to move with the mounting bolt 340. The mounting bolt 340 is attached to or is integrally formed from a part of the face mask 210 for mounting the face mask 210 to the attachment point 220.

In an embodiment, the mounting ring 330 is adapted to slide in any lateral direction within a mounting sleeve 310 upon receiving an impact force on the face mask 220 via the bolt 340, but the lateral movement of the mounting ring 330 is also opposed by a plurality of resiliently flexible impact absorption components 350 which are positioned radially around each mounting ring 330. In the illustrative embodiment shown in FIGS. 3A and 3B, the plurality of resiliently flexible impact absorption components 330 are resiliently flexible springs 350 which are attached at a first end to a mounting ring 330, and attached at a second end to an inner wall of the mounting sleeves 310. The plurality of springs 350 are mounted radially around the mounting ring 330 and center the mounting ring 330 within the mounting sleeve 310.

Figure 4A:
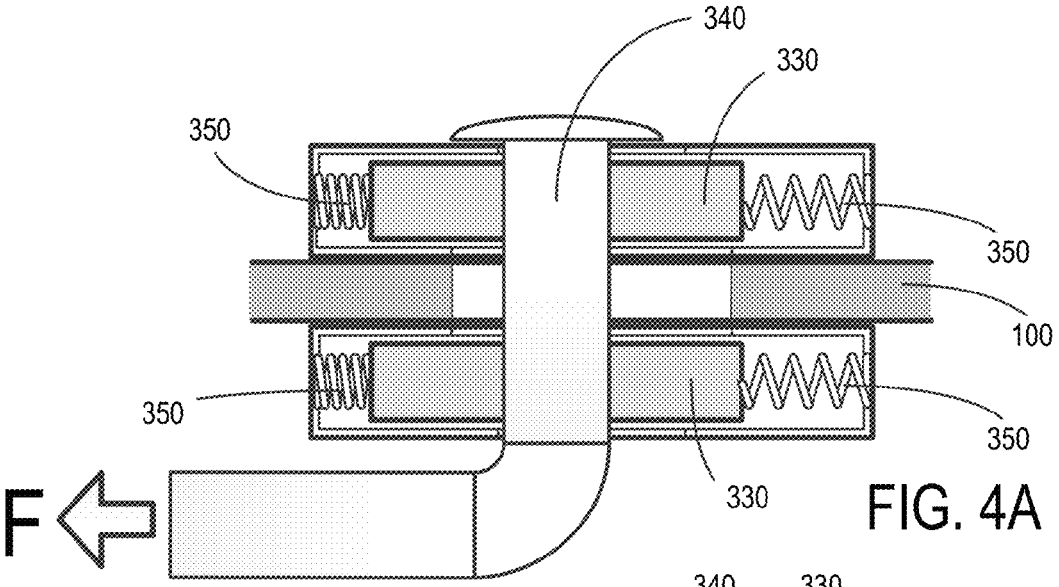
FIGS. 4A to 4C show an illustration of the face mask mounting apparatus of FIGS. 3A and 3B in use, as a mounting ring moves from side to side within a mounting sleeve.
Figure 4B:
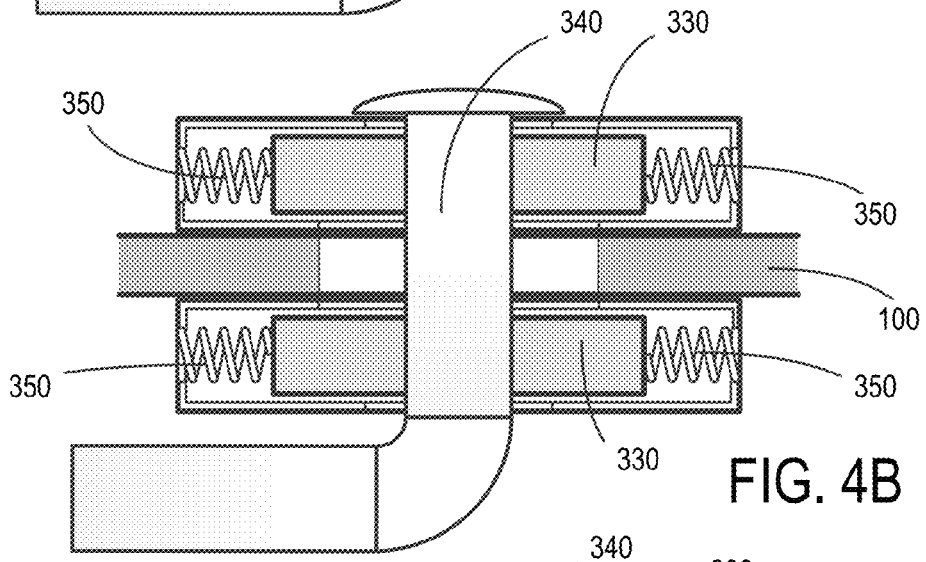
Figure 4C:
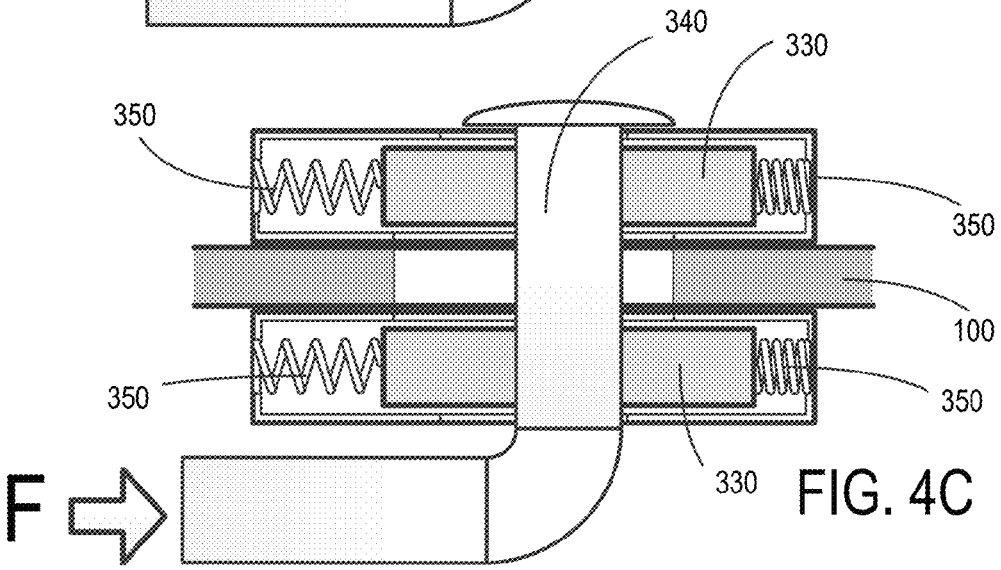

FIGS. 4A to 4C show an illustration of the face mask mounting apparatus 300 of FIGS. 3A and 3B in use. As shown, the plurality of springs 350 in each mounting sleeve 310 are adapted to compress or stretch, depending on the lateral direction of the mounting ring 330, in response to an impact force F. The plurality of springs 350 also collectively act to return the mounting ring 330 to its original position in the center of the mounting sleeve 310 after an impact force F is absorbed.

While the example in FIGS. 3A and 3B, shown in use in FIGS. 4A to 4C, illustrates a pair of mounting sleeves 310 mounted on either side of an aperture 320 formed at an attachment point 220 on a contact sports helmet 100, it will be appreciated that only one mounting sleeve 310 may be used, on one side. However, the use of a pair of mounting sleeves 310 on either side of an aperture 320 formed at an attachment point 220 may act to provide a more secure mount for the mounting bolt 340, and also increase the amount of impact force F the face mask mounting apparatus 300 can withstand by increasing the number of resiliently flexible impact absorption components 350.

Figure 5A:
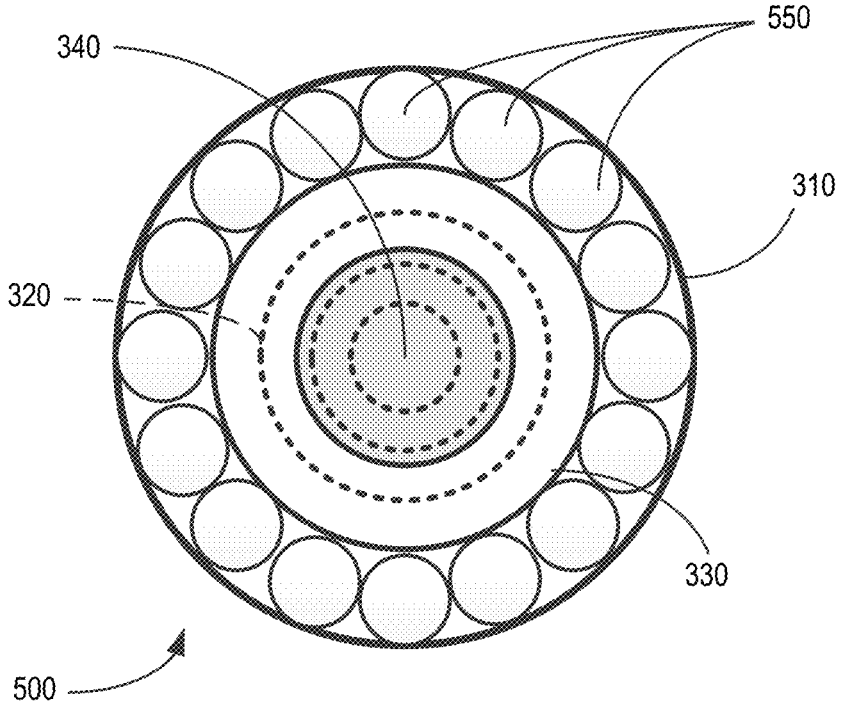
FIG. 5A shows a detailed partial cross-sectional top view of a face mask mounting apparatus in accordance with another embodiment.
Figure 5B:
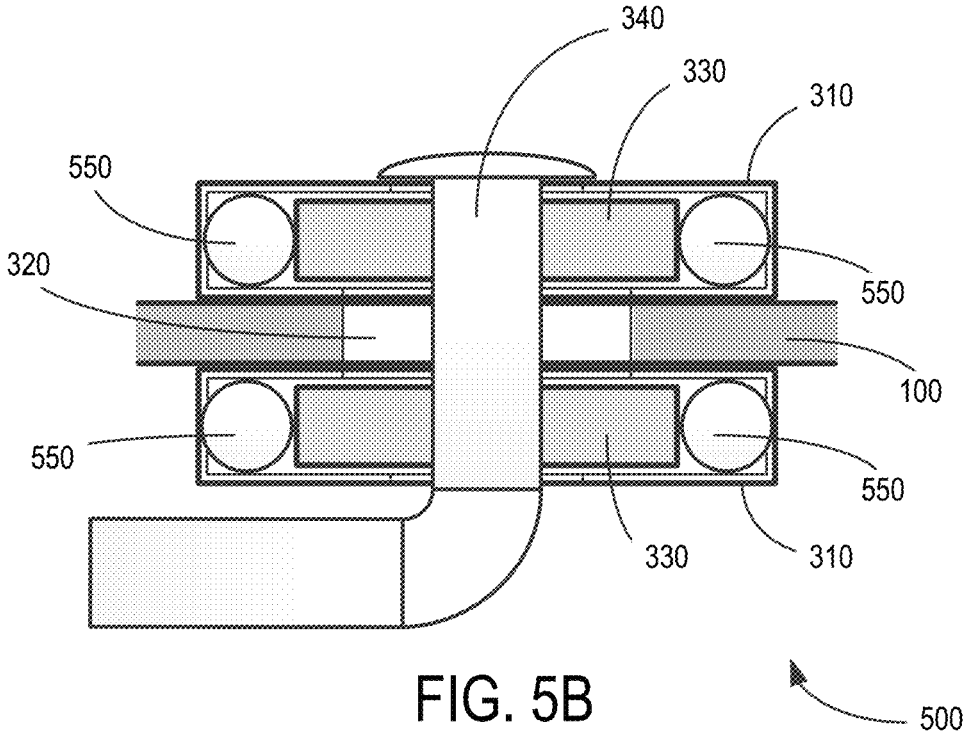
FIG. 5B shows a corresponding partial cross-sectional side view of the face mask mounting apparatus of FIG. 5A.
Figure 6A:
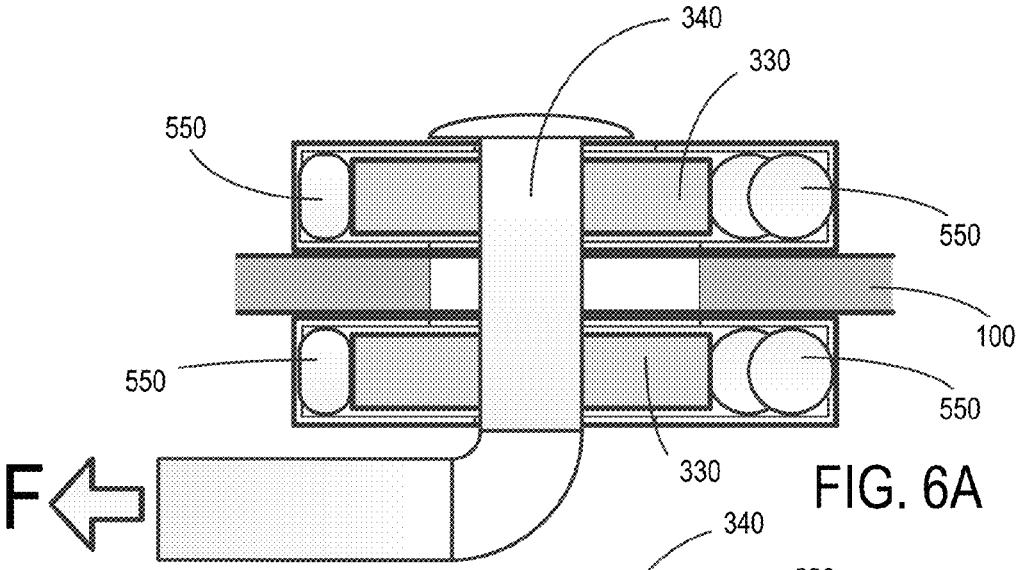
FIGS. 6A to 6C show an illustration of the face mask mounting apparatus of FIGS. 5A and 5B in use, as a mounting ring moves from side to side within a mounting sleeve.
Figure 6B:
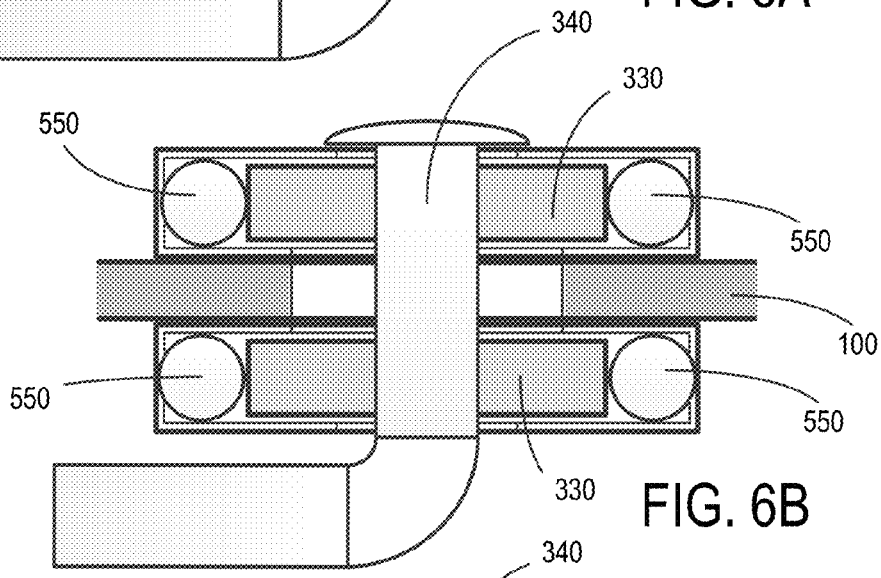
Figure 6C:
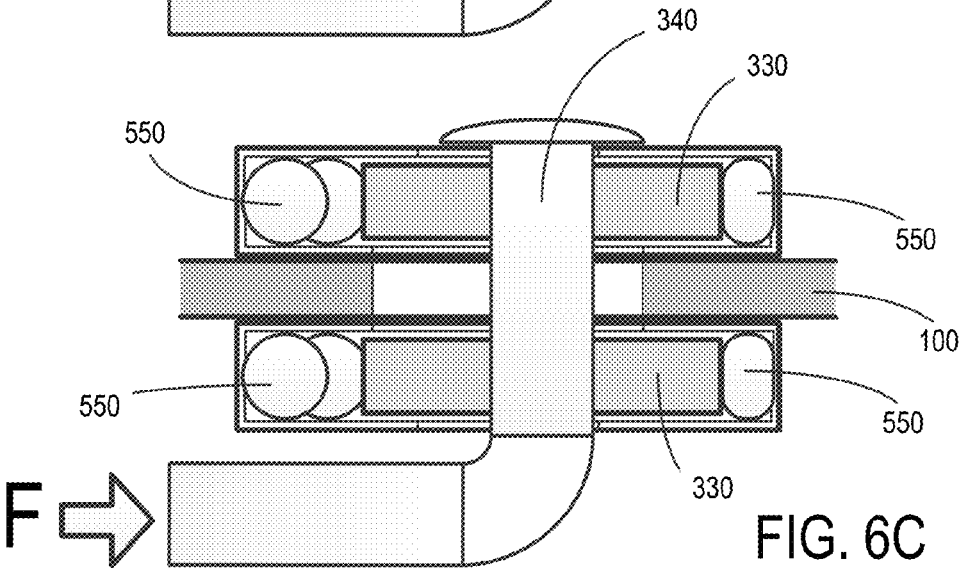

Now referring to FIG. 5A, shown is a detailed partial cross-sectional top view of a face mask mounting apparatus 500 in accordance with another embodiment. FIG. 5B shows a corresponding partial cross-sectional side view of the face mask mounting apparatus 500 of FIG. 5A. In this embodiment, the plurality of resiliently flexible impact absorption components 550 are resiliently flexible and deformable balls 550, such as soft rubber balls for example, which are radially positioned around a mounting ring 330 and sit between the mounting ring 330 and an inner wall of the mounting sleeve 310. Rather than being fastened to the mounting ring 330 or the inner wall of the mounting sleeve 310, the plurality of flexible rubber balls 550 are free to compress when an impact force F is received by the face mask 220, and the mounting ring 330 moves laterally within the mounting sleeve 310 in a corresponding direction. After the impact force F is absorbed, the plurality of flexible rubber balls 550 return the mounting ring 330 to its original centered position within the mounting sleeve 310. This is illustrated by way of example in FIGS. 6A to 6C, which shows how the resiliently flexible and deformable balls 550 work to absorb an impact force F. In this embodiment, as it is not necessary to mount individual springs to the mounting ring 330 and the mounting sleeve 310, the cost of manufacture for this embodiment may be reduced.

Figure 7:
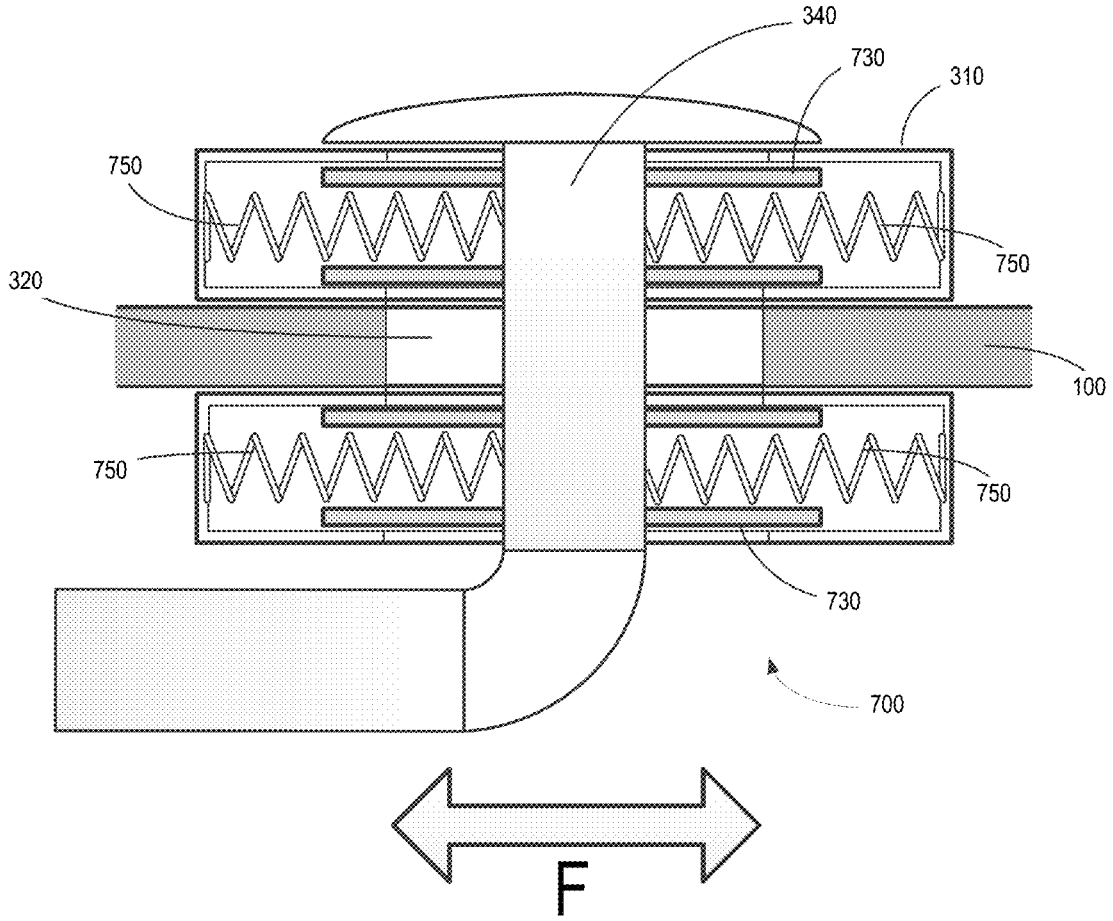
FIG. 7 shows a detailed partial cross-sectional side view of a face mask mounting apparatus in accordance with another embodiment, configured to provide a greater distance of lateral travel upon receiving an impact force.

Now referring to FIG. 7, shown is a detailed partial cross-sectional side view of a face mask mounting apparatus 700 in accordance with another embodiment. In comparison to the example shown in FIGS. 3A and 3B, the embodiment 700 shown in FIG. 7 is configured to provide a greater distance of lateral travel upon receiving an impact force F. This is accomplished by using springs 750 with a longer range of travel, and by using a mounting ring 730 that provides a spring attachment point closer to its center. By using different types of resiliently flexible impact absorption components 750 in alternative configurations, it will be appreciated that the amount of impact force F that can be absorbed by the face mask mounting apparatus 750 may be further increased, or decreased, as the circumstances may require.

Figure 8:
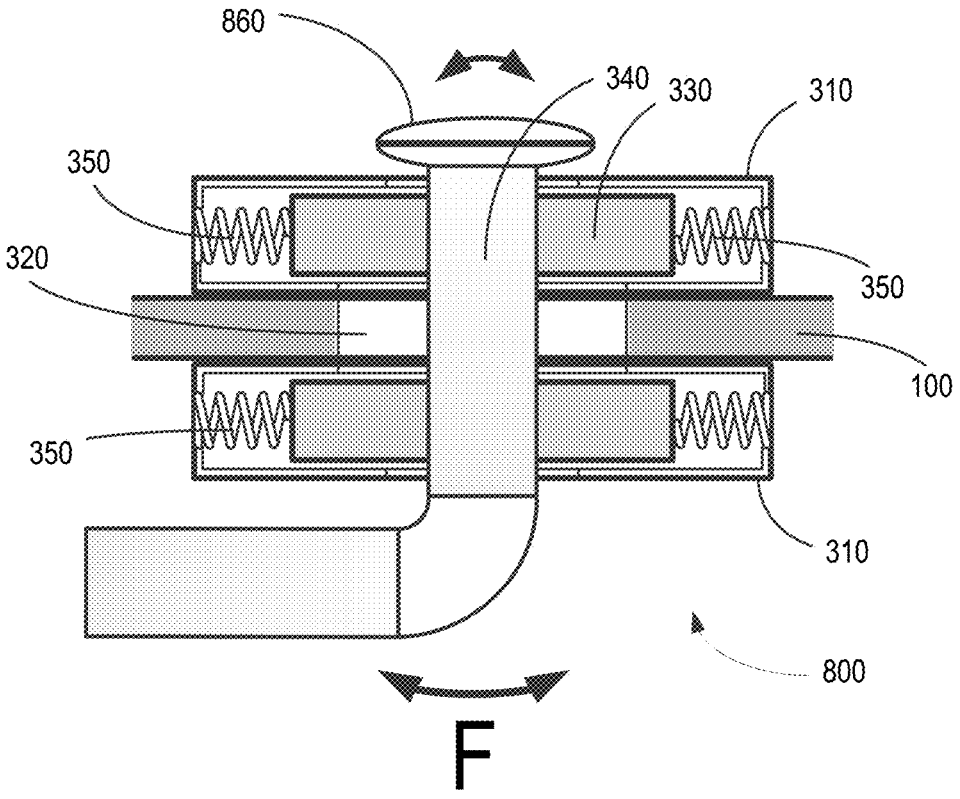
FIG. 8 shows a partial cross-sectional side view of the face mask mounting apparatus in accordance with another embodiment allowing the mounting apparatus to tilt within a limited range.

Now referring to FIG. 8, in another embodiment, the mounting apparatus 800 may be adapted to allow tilting within a limited range. In this embodiment, the head 860 of the mounting bolt 340 is curved on the side engaging the contact sports helmet 100, and the bolt 340 may tilt within a range allowed by the lateral movement of the inner mounting rings 330 in their respective mounting sleeves 310. This tilting motion allows yet another type of resiliently flexible impact absorption when the impact on the face mask 220 is not directly aligned with the lateral motion of the inner mounting rings 330.

Figure 9:
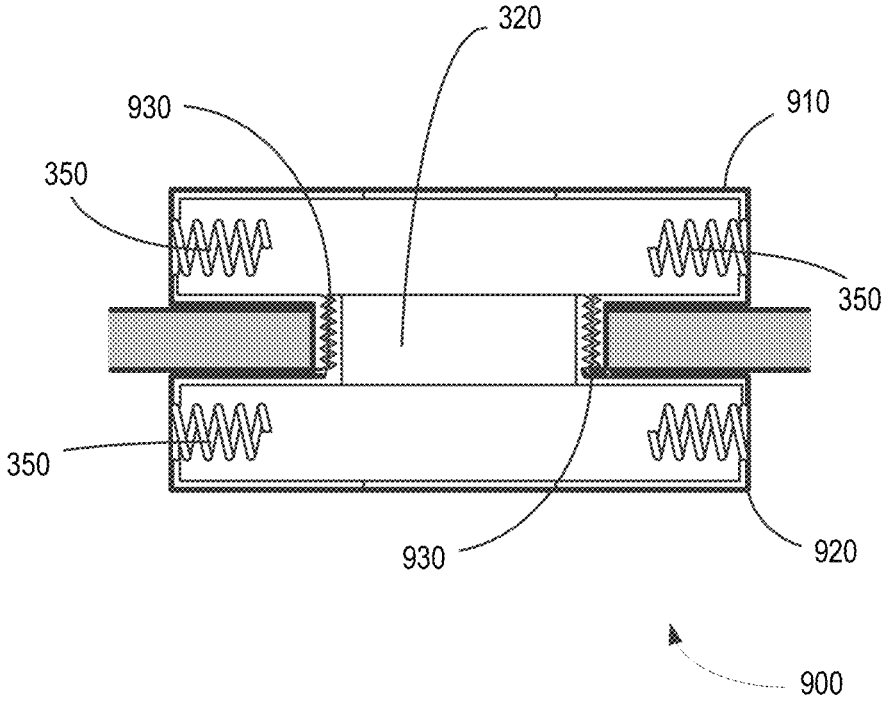
FIG. 9 shows a partial cross-sectional side view of the face mask mounting apparatus with the inner mounting rings and mounting bolt removed to show a coupling between the mounting sleeves on either side of a face mask attachment point.

Now referring to FIG. 9, shown is a partial cross-sectional side view of the face mask mounting apparatus with the inner mounting rings 330 and mounting bolt 340 removed to more clearly show a coupling between the mounting sleeves 910, 920 on either side of an aperture 320. In this illustrative embodiment, the coupling 930 is achieved, for example, by complementary screw threads allowing the first and second mounting sleeves 910, 920 to be rotated relative to each other until both first and second mounting sleeves 910, 920 are secured together.

Alternatively, the coupling between the first and second mounting sleeves 910, 920 may be achieved by a mechanical snap lock force fit between complementary interlocking features, or a bolt mechanism securing the first and second mounting sleeves 910, 920 together. Other mechanical coupling means, or a strong adhesive may also be used to couple the first and second mounting sleeves 910, 920 together. This coupling allows the first and second mounting sleeves 910, 920 to be exactly aligned to receive the mounting bolt 340 through both mounting sleeves 910, 920, and to allow their respective inner mounting rings 330 (not shown in FIG. 9) and plurality of resiliently flexible impact absorption components (e.g. springs) 350 to collectively act to absorb an impact force on the face mask 110.

Thus, in an aspect, there is provided a face mask mounting apparatus for a contact sports helmet, comprising: a first mounting sleeve adapted to be mounted at a face mask attachment point on the contact sports helmet; a first inner mounting ring encased in the first mounting sleeve and adapted to receive a mounting bolt; and a plurality of resiliently flexible impact absorption components positioned between the first inner mounting ring and an inner wall of the first mounting sleeve to generally centrally position the first inner mounting ring within the first mounting sleeve; whereby, in use, the plurality of resiliently flexible impact absorption components are adapted to collectively absorb an impact force received on the face mask by deforming, and returning the inner mounting ring to its central position within the first mounting sleeve after the impact force has been absorbed.

In an embodiment, the face mask mounting apparatus for a contact sports helmet further comprises: a second mounting sleeve adapted to be mounted opposite the first mounting sleeve at the face mask attachment point on the contact sports helmet; a second inner mounting ring encased in the second mounting sleeve and adapted to receive the mounting bolt; and a plurality of resiliently flexible impact absorption components positioned between the second inner mounting ring and an inner wall of the second mounting sleeve to generally centrally position the second inner mounting ring within the second mounting sleeve; whereby, in use, the plurality of resiliently flexible impact absorption components within the first and second mounting sleeves are adapted to collectively absorb an impact force received on the face mask by deforming, and returning the first and second inner mounting rings to their respective central positions within the first and second mounting sleeves after the impact force has been absorbed.

In another embodiment, the first and second mounting sleeves are adapted to couple together at the face mask attachment point on the contact sports helmet.

In another embodiment, the first and second mounting sleeves are adapted to be coupled together via compatible interlocking features.

In another embodiment, the first and second mounting sleeves are adapted to be coupled together via compatible screw threads.

In another embodiment, the first and second mounting sleeves are adapted to be coupled together via a mechanical snap lock force fit, a strong adhesive or other coupling means.

In another embodiment, the plurality of resiliently flexible impact absorption components comprise springs that are attached at a first end to the first or second inner mounting rings, and attached at a second end to an inner wall of their respective first or second mounting sleeves.

In another embodiment, the plurality of resiliently flexible impact absorption components comprise resiliently flexible and deformable rubber balls.

In another embodiment, the first and second inner mounting rings are adapted to move independently of each other to allow the mounting bolt to tilt within a range allowed by the lateral movement of the first and second inner mounting rings in their respective first and second mounting sleeves.

In another embodiment, the contact sport is one of football, hockey and lacrosse.

While various illustrative embodiments have been described above by way of example, it will be appreciated that various changes and modifications may be made without departing from the scope of the invention, which is defined by the following claims.

The invention claimed is:

1. A face mask mounting apparatus for connecting a face mask to a contact sports helmet, comprising:
   - a first mounting sleeve adapted to be mounted at a face mask attachment point on the contact sports helmet;
   - a first inner mounting ring encased in the first mounting sleeve and adapted to receive a mounting bolt attached to or formed on the face mask; and
   - a plurality of resiliently flexible impact absorption components positioned between the first inner mounting ring and an inner wall of the first mounting sleeve to generally centrally position the first inner mounting ring within the first mounting sleeve;
   - whereby, in use, the plurality of resiliently flexible impact absorption components are adapted to collectively absorb an impact force received on the face mask by deforming, and returning the inner mounting ring to a central position within the first mounting sleeve after the impact force has been absorbed.

2. The face mask mounting apparatus of claim 1, further comprising:
   - a second mounting sleeve adapted to be mounted opposite the first mounting sleeve at the face mask attachment point on an opposing side of the contact sports helmet;
   - a second inner mounting ring encased in the second mounting sleeve and adapted to receive the mounting bolt; and
   - a plurality of resiliently flexible impact absorption components positioned between the second inner mounting ring and an inner wall of the second mounting sleeve to generally centrally position the second inner mounting ring within the second mounting sleeve;
   - whereby, in use, the plurality of resiliently flexible impact absorption components within the first and second mounting sleeves are adapted to collectively absorb an impact force received on the face mask by deforming, and returning the first and second inner mounting rings to their respective central positions within the first and second mounting sleeves after the impact force has been absorbed.

3. The face mask mounting apparatus of claim 2, wherein the first and second mounting sleeves are adapted to couple together at the face mask attachment point on the contact sports helmet.

4. The face mask mounting apparatus of claim 3, wherein the first and second mounting sleeves are adapted to be coupled together via compatible interlocking features.

5. The face mask mounting apparatus of claim 3, wherein the first and second mounting sleeves are adapted to be coupled together via compatible screw threads.

6. The face mask mounting apparatus of claim 3, wherein the first and second mounting sleeves are adapted to be coupled together via a mechanical snap lock force fit, or an adhesive.

7. The face mask mounting apparatus of claim 2, wherein the plurality of resiliently flexible impact absorption components comprise springs that are attached at a first end thereof to the first or second inner mounting rings, and attached at a second end thereof to an inner wall of their respective first or second mounting sleeves.

8. The face mask mounting apparatus of claim 2, wherein the plurality of resiliently flexible impact absorption components comprise resiliently flexible and deformable rubber balls.

9. The face mask mounting apparatus of claim 2, wherein the first and second inner mounting rings are adapted to move independently of each other to allow the mounting bolt to tilt within a range allowed by the lateral movement of the first and second inner mounting rings in their respective first and second mounting sleeves.

10. The face mask mounting apparatus of claim 1, wherein the contact sports helmet is one of a football helmet, a hockey helmet and a lacrosse helmet.

* * * * *